United States Patent [19]

Kirby

[11] 4,285,565

[45] Aug. 25, 1981

[54] ELECTRICAL CONNECTOR

[75] Inventor: Edward Kirby, Mt. Prospect, Ill.

[73] Assignee: TRW Inc., Cleveland, Ohio

[21] Appl. No.: 95,227

[22] Filed: Nov. 19, 1979

[51] Int. Cl.[3] ..... H01R 9/09

[52] U.S. Cl. ..... 339/176 MP

[58] Field of Search ..... 339/17 L, 75 MP, 176 MP

[56] References Cited

U.S. PATENT DOCUMENTS

| | | | |
|---|---|---|---|
| 3,016,508 | 1/1962 | Lalonde | 339/17 |
| 3,671,917 | 6/1972 | Ammon et al. | 339/17 L |
| 3,783,433 | 1/1974 | Kurtz et al. | 339/176 MP |

OTHER PUBLICATIONS

TRW Inc., Cinch Division, Drawing of Electrical Contact Assembly.

*Primary Examiner*—Neil Abrams

*Attorney, Agent, or Firm*—Yount & Tarolli

[57] ABSTRACT

A connector for making electrical contact with a printed circuit board includes a pair of contact members which are disposed in a housing. The contact members have cantilevered spring sections which engage each other to complete an electrical circuit. The cantilevered spring sections diverge from their area of engagement and extend through slots in interior walls of the housing. The cantilevered spring sections have T-shaped end sections which span the slots and are engageable with the interior walls of the housing to prevent the contact members from moving out of the slots and being trapped between the interior walls of the housing. The cantilevered spring sections of the contact members have arcuate connector sections which have their centers of curvature located between the contact members. In addition, the cantilevered spring sections have arcuate contact sections which curve in a direction opposite the direction of curvature of the connector sections.

9 Claims, 6 Drawing Figures

ELECTRICAL CONNECTOR

BACKGROUND OF THE INVENTION

This invention relates to a connector for making electrical contact with a printed circuit board, commonly referred to as a shorting connector.

Shorting connectors include a pair of shorting contacts which cooperate with a contact of a printed circuit board which is plugged into the area between the pair of shorting contacts. When the printed circuit board contact is removed from between the shorting contacts, the shorting contacts close, i.e., contact each other. A major problem with shorting connectors is the fact that one of the shorting contacts may become located in the area which is to receive the printed circuit board contact, and thus the shorting contact blocks or interferes with movement of the printed circuit board contact between the shorting contacts.

A known shorting connector is illustrated in FIG. 1. This connector includes a housing 10 having a pair of interior walls 12 and 14 with slots 16 and 18. A pair of contact members 20 and 22 are designed to be disposed in the slots 16 and 18. The contact members 20 and 22 should engage each other at a location midway between the two interior walls 12 and 14 of the housing 10. When so located, a contact of a printed circuit board can be readily inserted between the contact members 20 and 22. However for a variety of reasons, one of the contact members may move out of its slot and become trapped between the walls of the housing. For example, the contact member 20 is illustrated in FIG. 1 outside of its slot 16 and trapped between the housing walls 12 and 14.

With a contact trapped between the housing walls 12 and 14 in the manner shown in FIG. 1, it is impossible to move the circuit board into the housing 10, without damaging at least one of the contacts 20 and 22. The tendency for normally closed contacts to become trapped in the manner illustrated in FIG. 1 is accentuated by the fact that the contacts are formed so that they normally press against each other in the central portion of the housing 10. Therefore, when one of the contacts is displaced outwardly away from the central portion of the housing, the other contact tends to move into the central portion of the housing. Such can occur if a warpped printed circuit board is inserted between the contacts.

SUMMARY OF THE PRESENT INVENTION

The present invention prevents the contact members from being trapped between the walls of a housing in the manner illustrated in the prior art example of FIG. 1. The contact members constructed according to the present invention have generally T-shaped end portions. Each of the T-shaped end portions has a stem which extends through a slot in the housing and a cross section which spans the slot in the housing to prevent the contact from moving out of the slot. This positively prevents the contact members from being dislodged from the housing slots and trapped between the housing walls.

In addition, the contact members have a relatively long cantilevered spring section. As a result, the pressure between the normally closed contacts of different connectors is more uniform than provided by shorter cantilevered sections. This uniform pressure results in the constrictive resistance between the normally closed contacts of different connectors being of a more readily predicted magnitude and more uniform. The more uniform pressure between the normally closed contacts is obtained by curving cantilevered spring sections of the contacts to tend to maximize the overall length of the cantilevered spring sections.

Accordingly, it is an object of this invention to provide a new and improved connector having contact members with end sections constructed to prevent the contact members from being dislodged from associated slots in a housing.

Another object of this invention is to provide a new and improved normally closed contact assembly having contact members which are relatively long and press against each other and against the printed circuit board with a relatively uniform spring force.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 2:
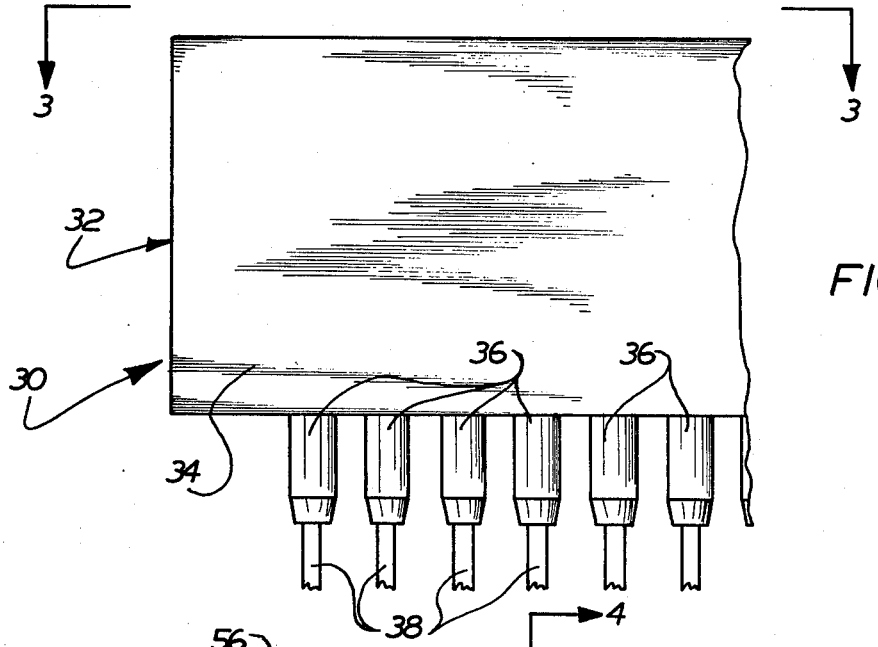
FIG. 2 is a side view of an assembly containing a plurality of connectors constructed in accordance with the present invention.
Figure 3:
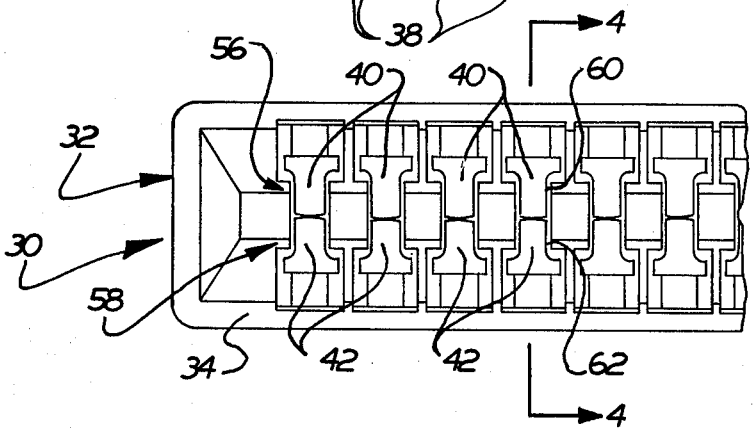
FIG. 3 is a plan view, taken generally along the line 3—3 of FIG. 2, illustrating the relationship between a plurality of connectors constructed in accordance with the present invention.

A socket-type connector assembly 30 constructed in accordance with the present invention is illustrated in FIGS. 2 and 3 and includes a housing 32 having a rectangular body portion 34 from which a plurality of cylindrical support sections 36 extend. Terminal end portions 38 of contact members 40 and 42 (see FIG. 4) extend axially outwardly from the cylindrical housing support sections 36. The terminal end portions 38 have a square or rectangular cross sectional configuration and are adapted to be connected with suitable wires in a known manner.

The housing 32 is adapted to receive a plug-type connector, such as a printed circuit board or the like, which has contact strips which are engageable with the contact members 40 and 42. Upon insertion of a plug-type connector into the housing 32, the contact members 40 and 42 are separated and engage the plug-type connector.

The normally closed contact members 40 and 42 have mounting sections 46 and 48 (FIG. 4) which are gripped by the housing 32 to hold the contact members against axial movement relative to the housing. It is contemplated that the mounting sections 46 and 48 of the contact members 40 and 42 will be provided with suitable serrations or retaining flanges (not shown) which are engaged by the dielectric material of the housing to hold the contact members against axial movement relative to the housing.

Figure 4:
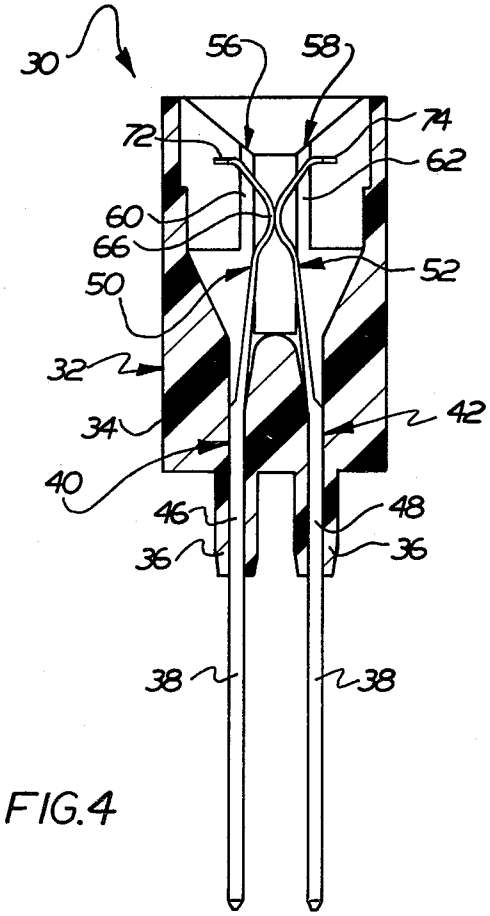
FIG. 4 is a sectional view, taken generally along the line 4—4 of FIG. 3, illustrating the relationship between a housing and a pair of contact members of a connector constructed in accordance with the present invention.

The contact members 40 and 42 are provided with cantilevered spring sections 50 and 52 (FIG. 4). The cantilevered spring sections 50 and 52 extend upwardly from the mounting sections 46 and 48 and abut at a location midway between a pair of parallel interior walls 56 and 58 of the housing 32. The wall 56 has a vertically extending (as viewed in FIGS. 4 and 5) slot 60 through which the cantilevered spring section 50 extends. Directly across from the slot 60 is a slot 62. The slots 60 and 62 have longitudinal central axes which extend parallel to each other and to the longitudinally extending terminal end sections 38 of the contact members 40 and 42.

The cantilevered spring section 50 extends through the slot 60 in the wall 56. Similarly, the cantilevered spring section 52 extends through the slot 62 in the wall 58. The cantilevered spring section 50 has an arcuate contact section 66 (see FIGS. 4 and 5) which is disposed in abutting pressure engagement with an arcuate contact section 68 of the cantilevered spring section 52 at a location midway between the two interior walls 56 and 58 of the housing 32.

Figure 5:
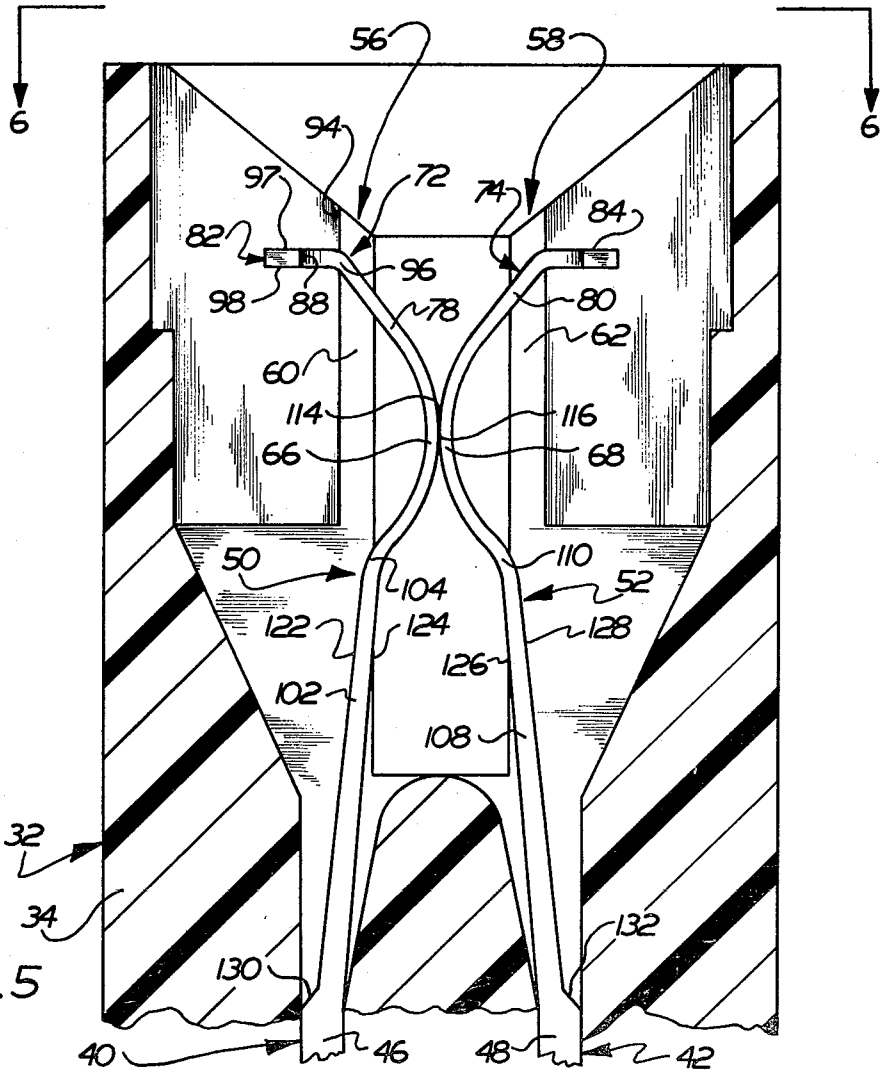
FIG. 5 is an enlarged fragmentary view of a portion of FIG. 4 further illustrating the relationship between the contact members.
Figure 6:
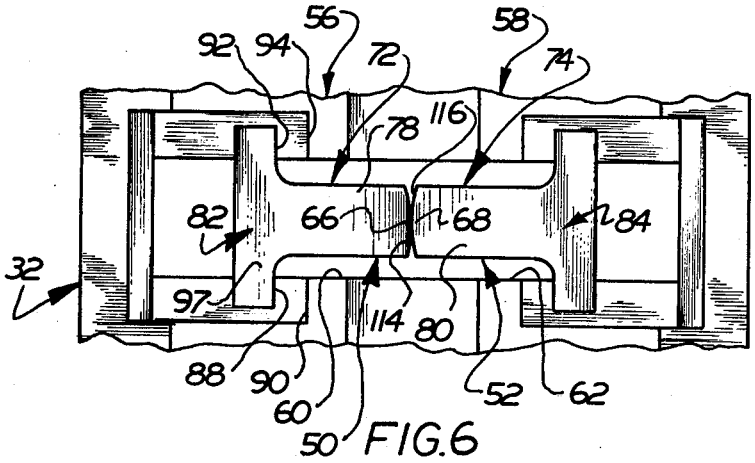
FIG. 6 is a plan view, taken generally along the line 6—6 of FIG. 5, illustrating the relationship between T-shaped end portions of the contact members and slots formed in the interior walls of the housing.

In accordance with one of the features of the invention, the cantilevered spring sections 50 and 52 have end portions 72 and 74 with generally T-shaped configurations (see FIGS. 5 and 6). The T-shaped end portions 72 and 74 cooperate with the interior walls 56 and 58 of the housing 32 to prevent the contact members 40 and 42 from moving out of their slots 60 and 62 and becoming trapped between the walls 56 and 58. Therefore, neither of the contact members 40 and 42 can become trapped in a manner similar to that in which the contact 20 is trapped between the walls 12 and 14 in FIG. 1.

The T-shaped end portions 72 and 74 of the cantilevered spring sections 50 and 52 have stem portions or connector sections 78 and 80 (see FIG. 5) and cross sections 82 and 84. The stem portions 78 and 80 extend between the arcuate contact sections 66 and 68 and the cross sections 82 and 84. The cross sections 82 and 84 span the slots 60 and 62 (see FIG. 6). Since the cross sections 82 and 84 span the slots 60 and 62, the end portions 72 and 74 of the cantilevered spring sections 50 and 52 cannot move through the slots and become trapped between the interior walls 56 and 58 of the housing 32.

When the end portion 72 of the cantilevered spring section 50 tends to be dislodged from the slot 60, the cross section 82 moves from a normal position (FIG. 6) separated from the wall 56 into engagement with the wall. The cross section 82 engages the interior wall 56 on opposite sides of the slot 60 to retain the cantilevered spring section 50 in the slot. Thus, a vertically extending (as viewed in FIG. 6) minor side surface 88 on the cross section 82 moves into flat abutting engagement with a vertically extending side surface 90 on the wall 56. Similarly, a minor side surface 92 on the opposite side of the cross section 82 moves into flat abutting engagement with a vertical side surface 94 adjacent to the opposite side of the slot 60.

In order to provide for flat abutting engagement of the minor side surfaces 88 and 92 with the side surfaces 90 and 94 of the wall section 56 on opposite sides of the slot 60, the stem 78 of the T-shaped end section 72 has an arcuate bend 96 (FIG. 5). This bend results in flat parallel upper and lower major side surfaces 97 and 98 of the cross section 82 extending perpendicular to the side surfaces 90 and 94 of the wall section 56 (see FIG. 5). Therefore the minor side surfaces 88 and 92 extend parallel to the side surfaces 90 and 94 (FIG. 6) of the wall section 56.

Although only the end portion 72 of the cantilvered spring section 50 has been described in detail, it should be understood that the end portion 74 of the cantilevered spring section 52 has a configuration which is the same as the configuration of the end portion 72 of the cantilevered spring section 50. The end portion 74 of the cantilevered spring section 52 cooperates with the interior wall 58 of the housing 32 in the same manner as in which the end portion 72 of the cantilevered spring section 50 cooperates with the wall 56.

In accordance with another feature of the present invention, the cantilevered spring sections 50 and 52 are relatively long to provide for the distribution of stress over a substantial length. Accordingly, the spring section 50 has a linear body section 102 which is connected with the arcuate contact section 66 by an arcuate connector section 104. The arcuate connector section 104 has a center of curvature which is located on the right (as viewed in FIG. 5) of the cantilevered spring section 50. The arcuate contact section 66 has a center of curvature which is located on the left (as viewed in FIG. 5) of the cantilevered spring section. By bending the connector section 104 in the opposite direction from the contact section 66, the overall length of the cantilevered spring section 50 tends to be maximized within the vertical extent of the housing 32.

Similarly, the cantilevered spring section 52 has a linear body section 108 which is connected with the arcuate contact section 68 by an arcuate connector section 110. The arcuate connector section 110 has a center of curvature which is disposed on the left (as viewed in FIG. 5) of the cantilevered spring section 52. The arcuate contact section 68 has a center of curvature which is disposed on the right (as viewed in FIG. 5) of the cantilevered spring section 52. Thus, the centers of curvatures of the connector sections 104 and 110 are disposed between the two cantilevered spring sections 50 and 52 while the centers of curvature of the arcuate contact sections 66 and 68 are disposed adjacent outwardly facing sides of the cantilevered spring sections 50 and 52.

The arcuate contact sections 66 and 68 have contact surface areas 114 and 116 which are normally disposed in abutting engagement to provide an electrical connection between the contact members 40 and 42. In addition to having a longitudinally curving configuration as shown in FIG. 5, the arcuate contact sections 66 and 68 have a transversely curving configuration (see FIG. 6). The longitudinally and transversely curving configuration of the contact sections 66 and 68 results in firm abutting engagement between the contact surface areas 114 and 116 at a location midway between the interior walls 56 and 58 of the housing 32.

The cantilevered spring sections 50 and 52 press the contact surface areas 114 and 116 into abutting engagement with a pressure which is accurately reproduceable within a relatively small tolerance range. By providing for an accurately reproduceable contact pressure between the surfaces 114 and 116, the constrictive resistance of the electrical connection between the contact surfaces 114 and 116 is maintained within a predetermined range. In one specific embodiment of the invention, the cantilevered spring sections 50 and 52 press the contact surfaces 114 and 116 together with a spring force of between 200–400 grams. Of course, the spring force and the range of spring force with which the contact surfaces 114 and 116 are pressed together will vary with different embodiments of the invention.

The terminal end sections 38 (see FIG. 4) of the contact members 40 and 42 have generally square cross sectional configurations while the body sections 102 and 108 of the contact members 40 and 42 have rectangular configurations. The cross sectional area of the square terminal sections is the same as the cross sectional area of the rectangular body sections 102 and 108 of the contact members 40 and 42. However, the body sections 102 and 108 of the contact members have major side surfaces 122, 124, 126 and 128 which are wider in a direction extending perpendicular to the longitudinal central axes of the body sections 102 and 108 than are the side surface of the terminal sections 38. The change in the cross sectional area of the contact members 40 and 42 occurs at inwardly sloping side surfaces 130 and 132 (FIG. 5) which extend between the mounting sections 46 and 48 and the cantilevered spring sections 50 and 52.

Figure 1:
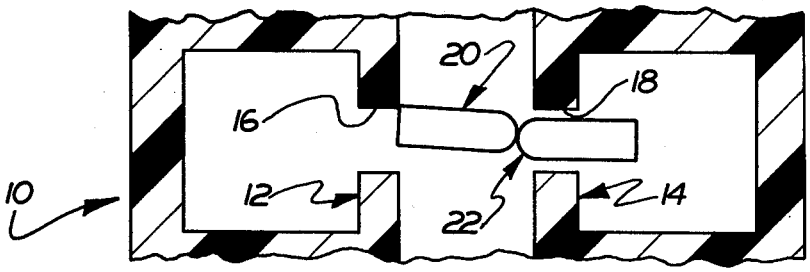
FIG. 1 (PRIOR ART)
FIG. 1 is an illustration of a prior art connector with one of the contact members being shown trapped between interior walls of the contact assembly.

In view of the foregoing, it is apparent that the present invention prevents normally closed contact members 40 and 42 from being trapped between the walls 56 and 58 of a housing 32 in the manner illustrated in the prior art example of FIG. 1. Thus, normally closed contact members 40 and 42 constructed according to the present invention have generally T-shaped free end portions 72 and 74. Each of the T-shaped end portions 72 and 74 has a stem 78 or 80 which extends through a slot 60 or 62 in the housing 32 and a cross or head section 82 or 84 which spans the slot 60 or 62 in the housing to prevent the contact from moving out of the slot. This prevents the contact members 40 and 42 from being dislodged and trapped between the housing walls under the influence of a warpped conductor board or forces encountered in handling of a contact assembly.

In addition, the contact members 40 and 42 have relatively long cantilevered spring sections 50 and 52 which promote a uniform pressure between the normally closed contact members. This uniform pressure results in the constrictive resistance between the normally closed contacts 40 and 42 being of a more readily predicted magnitude. The more uniform pressure between the normally closed contacts 40 and 42 is obtained by curving cantilevered spring sections 50 and 52 of the contacts to tend to maximize the overall length of the cantilevered spring sections. Although the actual spring forces which are present in various embodiments of the invention will differ, in one specific instance the spring force between a substantial number of normally closed contacts 40 and 42 was in the range of 200–400 grams. With a known set of normally closed contacts having a construction similar to that illustrated in FIG. 1, the spring force varied in a range of from 100–500 grams.

Having described a specific preferred embodiment of the invention, the following is claimed:

1. A connector for making electrical contact with a printed circuit board or the like comprising a housing formed of an electrical insulating material, said housing including first and second spaced wall sections defining an area into which a portion of the circuit board is inserted, said first wall section defining a first slot, said second wall section defining a second slot which extends parallel to and is disposed directly across from said first slot, first and second contact members having mounting sections held by said housing, terminal sections projecting out of said housing and movable cantilevered spring sections disposed within said housing, said cantilevered spring sections including contact surface means disposed in the space between said first and second wall sections and disposed in abutting engagement with each other for completing an electrical connection therebetween and movable from abutting engagement with each other by insertion of a portion of a circuit board between said contact surface means to complete an electrical connection with the portion of the circuit board, said first and second contact means including respective first and second end sections which extend through respective slots in said first and second wall sections and each of said first and second end sections having a stop engageable with a respective portion of said housing to limit the amount of movement of said first and second contacts into said area, the stops on each of said first and second end sections having a normal position spaced from engagement with its respective portion of said housing when said cantilevered spring sections are disposed in abutting engagement with each other and each of said stops being movable from its normal position into engagement with its respective portion of said housing in response to an amount of movement of its associated contact member toward the wall section associated with the other contact member.

2. A connector as defined in claim 1 wherein said first and second end sections are T-shaped, the stem of said T-shapes extending through said slots and the cross of each of said T-shapes being located in respective chambers on on the side of said first and second wall sections opposite the sides defining said area, said cross of said T-shaped first end section of said first contact member being engageable with said first wall section adjacent the opposite sides of said first slot to limit movement of said first contact member toward said second wall section, and said cross of said T-shaped second end section of said second contact member being engageable with said second wall section adjacent the opposite sides of said second slot to limit movement of said second contact member toward said first wall section, the cross of each of said first and second T-shaped end sections having a normal position spaced from engagement with its respective wall section when said cantilevered springs are in abutting engagement with each other and being movable from its normal position into engagement with its respective wall section in response to an amount of movement of its associated contact member toward the wall section associated with the other contact member.

3. A connector as set forth in claim 1 wherein said first cantilevered spring section has a longitudinally extending body section, an arcuate contact section upon which one of said contact surface means is disposed, and an arcuate connector section extending between said body section and said arcuate contact section, said arcuate contact section having a center of curvature which is disposed on a side of said first cantilevered spring section which is toward said first wall section, said arcuate connector section having a center of curvature which is disposed on a side of said first cantilevered spring section which is toward said second wall section.

4. A connector as set forth in claim 3 wherein said second cantilevered spring section has a longitudinally extending body section, an arcuate contact section upon which the other one of said contact surface means is disposed, and an arcuate connector section extending between said body section and said arcuate contact section, said arcuate contact section of said second cantilevered spring section having a center of curvature which is disposed on a side of said second cantilevered spring section which is toward said second wall section, said arcuate connector section of said second cantilevered spring section having a center of curvature which is disposed on a side of said second cantilevered spring section which is toward said first wall section.

5. A connector as set forth in claim 1 wherein said first and second end sections are T-shaped and have stem sections which extend through said slots and cross sections which are connected with and extend transversely to said stem sections and span said slots, each of said cross sections having major side surfaces which extend perpendicular to said first and second wall sections and minor side surfaces of said cross sections being engageable with said first and second wall sections to limit movement of said contact member, the major side surfaces of The cross section of each of said T-shaped first and second end sections having a normal position spaced from engagement with its respective wall section when said cantilevered springs are in abutting engagement with each other and being movable from its normal position into engagement with its respective wall section in response to an amount of movement of its associated contact member toward the wall portion associated with the other contact member.

6. A connector as set forth in claim 4 wherein said contact surface means are pressed into abutting engagement with each other by said cantilevered spring sections.

7. A connector as set forth in claim 5 wherein said minor side surfaces of said cross sections are spaced from said wall sections when said contact surface means are disposed in abutting engagement at a location midway between said wall sections.

8. A connector comprising a housing formed of an electrically insulating material, said housing including first and second parallel wall sections, said first wall section being spaced from said second wall section and defining a first slot, said second wall section defining a second slot which extends parallel to and is disposed directly across from said first slot, and first and second contact members disposed in said housing, said first and second contact members being movable from a closed condition disposed in abutting engagement with each other at a location between said first and second wall sections to provide an electrical connection beteen said first and second contact members to an actuated condition in which said first and second contact members are spaced from each other by insertion of a plug member into said contact assembly, said first contact member including a first mounting section held by said housing, a first terminal section extending outwardly from said first mounting section and housing in a first direction and adapted to be engaged by an electrical conductor, and a first movable cantilevered spring section extending outwardly from said first mounting section in a second direction which is opposite to said first direction, said first cantilevered spring section including a first body section which extends outwardly in the second direction from said first mounting section, a first contact section connected with said first body section and having surface means for engaging said second contact member at the location between said first and second wall sections, and a first free end section extending through said first slot in said first wall section, said first free end section including a first stem section extending through said first slot and a first cross section spanning said first slot, said first cross section having a pair of major side surfaces which extend perpendicular to a side surface of said first wall section and first and second minor side surfaces disposed between said major side surfaces and separated by said first stem section, said first minor side surface being abuttingly engageable with the side surface of said first wall section on one side of said first slot and said second minor side surface being abuttingly engageable with the side surface of said first wall section on another side of said first slot opposite from said one side to limit movement of said first contact section toward said second wall section, said second contact member including a second mounting section held by said housing, a second terminal section extending outwardly from said second mounting section and housing in the first direction and adapted to be engaged by an electrical conductor, and a second movable cantilevered spring section extending outwardly from said second mounting section in the second direction which is opposite to the first direction, said second cantilevered spring section including a second body section which extends outwardly in the second direction from said second mounting section, a second contact connected with said second body section and having surface means for engaging said first contact member at the location between said first and second wall sections, and a second free end section extending through said second slot in said second wall section, said second free end section including a second stem section extending through said second slot and a second cross section spanning said second slot, said second cross section having a pair of major side surfaces which extend perpendicular to a side surface of said second wall section and first and second minor side surfaces disposed between said major side surfaces and separated by said second stem section, said first minor side surface of said second cross section being abuttingly engageable with the side surface of said second wall section on one side of said second slot and said second minor side surface of said second cross section being abuttingly engageable with the side surface of said second wall section on another side of said second slot opposite from said one side of said second slot to limit movement of said second contact section toward said first wall section, said first and second minor side surfaces on said first cross section having a normal position spaced from engagement with respective side surfaces of said first wall section of said housing when said cantilevered spring sections are disposed in abutting engagement with each other and at least one of said first and second minor side surfaces on said first cross section being movable from its normal position into engagement with a respective side surface of said first wall section of said housing in response to an amount of movement of said first contact member toward said second wall section.

9. A connector as set forth in claim 8 wherein said first contact section has an arcuate configuration with a center of curvature which is disposed on a first side of said first contact member, said first side of said first contact member being adjacent to said first wall section, said first cantilevered spring section further including a first arcuate connector section extending between said first body section and said first contact section, said first arcuate connector section having a center of curvature which is disposed on a second side of said first contact member, said second side of said first contact member being opposite from said first side of said first contact member, said second contact section having an arcuate configuration with a center of curvature which is disposed on a first side of said second contact member, said first side of said second contact member being adjacent to said second wall section, said second cantilevered spring section further including a second arcuate connector section extending between said second body section and said second contact section, said second arcuate connector section having a center of curvature which is disposed on a second side of said second contact member, said second side of said second contact member being opposite from said first side of said second contact member.

* * * * *

UNITED STATES PATENT AND TRADEMARK OFFICE

CERTIFICATE OF CORRECTION

PATENT NO. : 4,285,565

DATED : August 25, 1981

INVENTOR(S) : Edward Kirby

It is certified that error appears in the above-identified patent and that said Letters Patent are hereby corrected as shown below:

Column 6, line 38, delete the word "on" second occurrence.

Column 7, line 27, change "The" to --the--.

Column 8, line 33, after "contact" insert --section--.

Signed and Sealed this

*First* Day of *December 1981*

[SEAL]

*Attest:*

GERALD J. MOSSINGHOFF

*Attesting Officer*

*Commissioner of Patents and Trademarks*